United States Patent [19]

Bane

[11] 4,154,578

[45] May 15, 1979

[54] METHOD AND APPARATUS FOR CLEANING A CARPET ON LOCATION

[76] Inventor: William F. Bane, 4533 Millersville Rd., Indianapolis, Ind. 46205

[21] Appl. No.: 820,554

[22] Filed: Aug. 1, 1977

[51] Int. Cl.[2] ..... B08B 3/00; A47L 7/00

[52] U.S. Cl. ..... 8/137; 8/139; 8/158; 15/320; 15/321; 68/20; 134/21; 134/37

[58] Field of Search ..... 8/137, 139

[56] References Cited

U.S. PATENT DOCUMENTS

| | | | |
|---|---|---|---|
| 3,505,004 | 4/1970 | Pfeil | 8/137 |
| 3,530,517 | 9/1970 | Nohl | 8/137 |
| 3,574,526 | 4/1971 | Bell | 8/137 |
| 3,614,797 | 10/1971 | Jones | 8/137 |
| 3,617,205 | 11/1971 | Wisdom | 8/137 |
| 3,733,176 | 5/1973 | Wisdom | 8/137 |
| 4,035,148 | 7/1977 | Metzger et al. | 8/137 |
| 4,095,303 | 6/1978 | Armstrong et al. | 15/1.5 R |

*Primary Examiner*—A. Lionel Clingman
*Attorney, Agent, or Firm*—Woodard, Weikart, Emhardt & Naughton

[57] ABSTRACT

A method and apparatus for cleaning a carpet on location without removing the carpet to a cleaning plant, the method comprising washing the carpet on location with an alkaline solution and neutralizing the alkaline residue left on the carpet after washing by blowing a spray of an acid solution under pressure into the washed carpet and removing the blown acid solution from the carpet after blowing by drawing a vacuum over the washed and blown carpet. The washing step also comprises blowing a heated spray of the alkaline solution under pressure into the carpet and removing the blown alkaline solution and loosened dirt from the carpet after blowing by drawing a vacuum over the blown carpet. The apparatus comprises a frame with wheels mounted thereon for transporting the frame to the carpet location, a first tank of alkaline solution, a second tank of acid solution, and a motor, solution pump and valved conduit arrangement for separately carrying the alkaline and acid solutions under pressure to a plurality of spray jets connected to an applicator head. A vacuum pump, vacuum return line and vacuum tank are also provided on the frame and connected to the head for removing and storing the blown alkaline and acid solutions and the loosened dirt.

8 Claims, 5 Drawing Figures

METHOD AND APPARATUS FOR CLEANING A CARPET ON LOCATION

BACKGROUND OF THE INVENTION

1. Field of the Invention

This invention relates to the field of portable "on location" steam carpet cleaning and particularly to a method and apparatus for cleaning a carpet on location while also retarding the rate of resoiling for the cleaned carpet.

2. Description of the Prior Art

Carpet-cleaning methods and apparata have been known and practiced for many years. In this regard, the following represents only a small sample of the many patents issued in this area.

| Pat. No. | Inventor | Issue Date |
|---|---|---|
| 1,240,799 | Gray | 9/18/17 |
| 2,572,142 | Hartenbach | 10/23/51 |
| 2,731,659 | Coplen | 1/24/56 |
| 2,789,031 | Caronia | 4/16/57 |
| 3,262,146 | Hays | 7/26/66 |
| 3,540,072 | Wolter et al. | 11/17/70 |
| 3,812,552 | Blackmon | 5/28/74 |
| 3,815,169 | Mooring | 6/11/74 |
| 3,919,729 | Cannan | 11/18/75 |

At first, carpets were removed from their location in the home or office and taken to plants where the cleaning process was accomplished. In such cleaning techniques, the carpets were generally tacked or nailed to a frame or border, scrubbed and rinsed thoroughly using various detergent solutions and buckets of clean water, and then stacked or hung up in a portion of the plant and allowed to dry. The dry, and hopefully unshrunken, carpets were then returned to their original locations until further cleaning was required.

In recent years, portable steam cleaning methods and apparata have been developed which permit the cleaning of carpets "on location," i.e., in the home, office or whatever, without having to remove the carpets and send them to an inplant operation. For the purposes of this application, and the specification and claims contained herein, any reference to cleaning or otherwise handling a carpet "on location" shall be meant to indicate a method or portable apparatus capable of cleaning or otherwise handling a carpet at its original location, i.e., in the home or office, and without removing the carpet to a separate cleaning facility.

These steam cleaning operations generally involve the use of a cleaning head which has at least one spray nozzle that operates to spray a dilute, hot detergent solution having a pH registering in the area of 10 or above into the surface of the carpet. A vacuum system often also incorporated in the head design then operates to remove the sprayed detergent solution and loosened dirt from the carpet and to carry them to a waste storage tank for later disposal.

The problem with such steam cleaning operations is the strong alkaline residue left on the carpets after cleaning. Upon checking the alkalinity of the carpet fiber immediately following such a cleaning, it is found that the carpet registers a pH just as high as the alkaline detergent used in the method. Such high alkalinity remains with the carpet fiber for a long time and greatly accelerates and increases the rate of resoiling for the particular carpet. This is true because dirt is generally acidic in character and will therefore be attracted to the alkaline residue left on the carpet fiber after cleaning. The "bottom line" is thus that the more an individual carpet is cleaned using such a method, the sooner the carpet will have to be cleaned again. The problems and inadequacies with such a situation are obvious.

Acid solutions have also been known and used in the art of carpet cleaning over the years. Specifically, acid solutions generally composed of acetic acid were often used in in-plant cleaning operations to stop the browning of some light-colored carpets and to treat the fringes of oriental rugs. After washing with a detergent solution, and with the carpet still nailed down as above described, workers would apply the acid solution, possibly containing acetic acid, sodium bifluoride, ammonium bifluoride or others, to the light carpet or oriental fringe using rubber gloves and sponges or brushes. After working the acid solution into the carpet, it was then rinsed thoroughly using ample clean water, as previously described, and set aside to dry before returning it to the customer.

Another use of acid solutions in carpet-cleaning operations, of which applicant is aware, was the attempted combination of an acid salt with an alkaline cleaning agent in a onestep cleaning method. Such attempt was totally unsuccessful in that the cleaning agent was neutralized by the free acid released in solution and the free acid attacked and ruined the pumps and other apparatus used in the operation.

SUMMARY OF THE INVENTION

One embodiment of the present invention comprises a method for cleaning a carpet on location without removing the carpet to a cleaning plant including the steps of washing the carpet on location with an alkaline solution and then neutralizing the alkaline residue left on the carpet after washing by blowing a spray of an acid solution under pressure into the washed carpet and then removing the blown acid solution from the carpet after blowing by drawing a vacuum over the washed and blown carpet.

The advantage of the above method over prior art home or office cleaning methods is that by neutralizing the alkaline residue left on the carpet after washing, the above method significantly retards the rate of resoiling for the individual carpet and therefore cuts down the frequency of required cleanings under normal circumstances. The cleaned carpet is left without any residue and at a neutral pH of between about 7 to 8 thereby indicating that dirt will not be drawn or attracted to the carpet fiber as with prior art methods.

One mode of practicing the above method involves washing the carpet by blowing a heated spray of the alkaline solution under pressure into the carpet fiber and then removing the blown alkaline solution and loosened dirt from the carpet after blowing by drawing a vacuum over the blown carpet. This results in maximum washing action and combines with the neutralizing step to produce a clean and soil-resistant carpet surface.

A second embodiment of the present invention comprises a portable apparatus for cleaning a carpet on location without removing the carpet to a cleaning plant including a frame, means including wheels mounted to the frame for transporting the frame to the carpet location, a first supply of alkaline solution on the frame, a second supply of acid solution, means connected to the first supply for blowing a heated spray of the alkaline solution under pressure into a carpet on location, means connected to the second supply for blowing a spray of the acid solution under pressure into a carpet on location, and means including a vacuum pump, a vacuum return line and a vacuum tank on the frame for removing and storing the blown alkaline and acid solutions and the loosened dirt.

In one mode of practicing the above second embodiment of the present invention, the means for blowing both the alkaline and acid solutions into the carpet comprises a head having a plurality of spray jets connected thereto, a two-way valve having two inlet lines and one outlet line, the outlet line being connected to the spray jets and the valve being operable to separately connect the inlet lines with the outlet line, means including a first solution pump for connecting the first supply to one of the two inlet lines on the valve, means including a second solution pump for connecting the second supply to the other of the two inlet lines on the valve, and a motor operable to run the first and second solution pumps and the vacuum pump.

One object of the present invention is to provide a method and apparatus for cleaning a carpet on location in the home or office in which the alkaline residue left on the carpet fiber after washing is neutralized thereby significantly retarding the rate of resoiling for the individual carpet.

Related objects and advantages of the present invention will be apparent from the following description.

DESCRIPTION OF THE PREFERRED EMBODIMENTS

Figure 1:
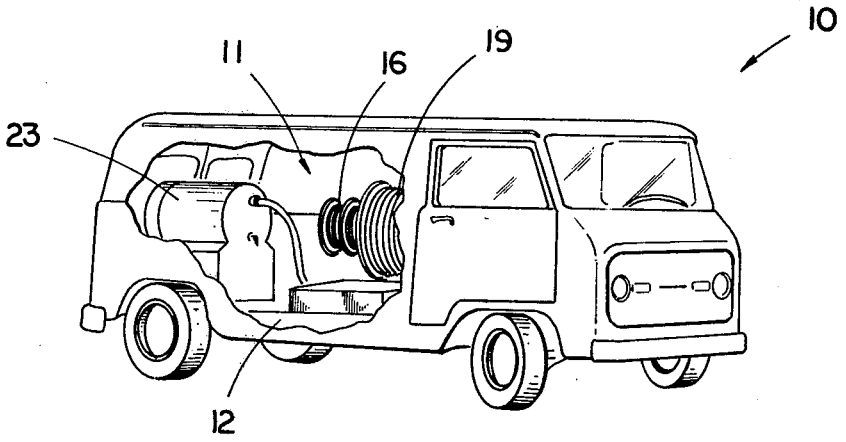
FIG. 1 is a perspective view of the mobile carpet-cleaning unit comprising the preferred embodiment of the present invention positioned in the back of a van.

For the purposes of promoting an understanding of the principles of the invention, reference will now be made to the embodiments illustrated in the drawings and specific langauge will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to FIG. 1, a cleaning van or truck 10 containing therein the mobile carpet-cleaning unit 11 comprising the preferred embodiment of the present invention is therein depicted. The mobile unit 11 is mounted on the bed or frame 12 of the van 10 and can thereby be transported to a home, office or other location, wherever carpet cleaning is required.

Figure 2:
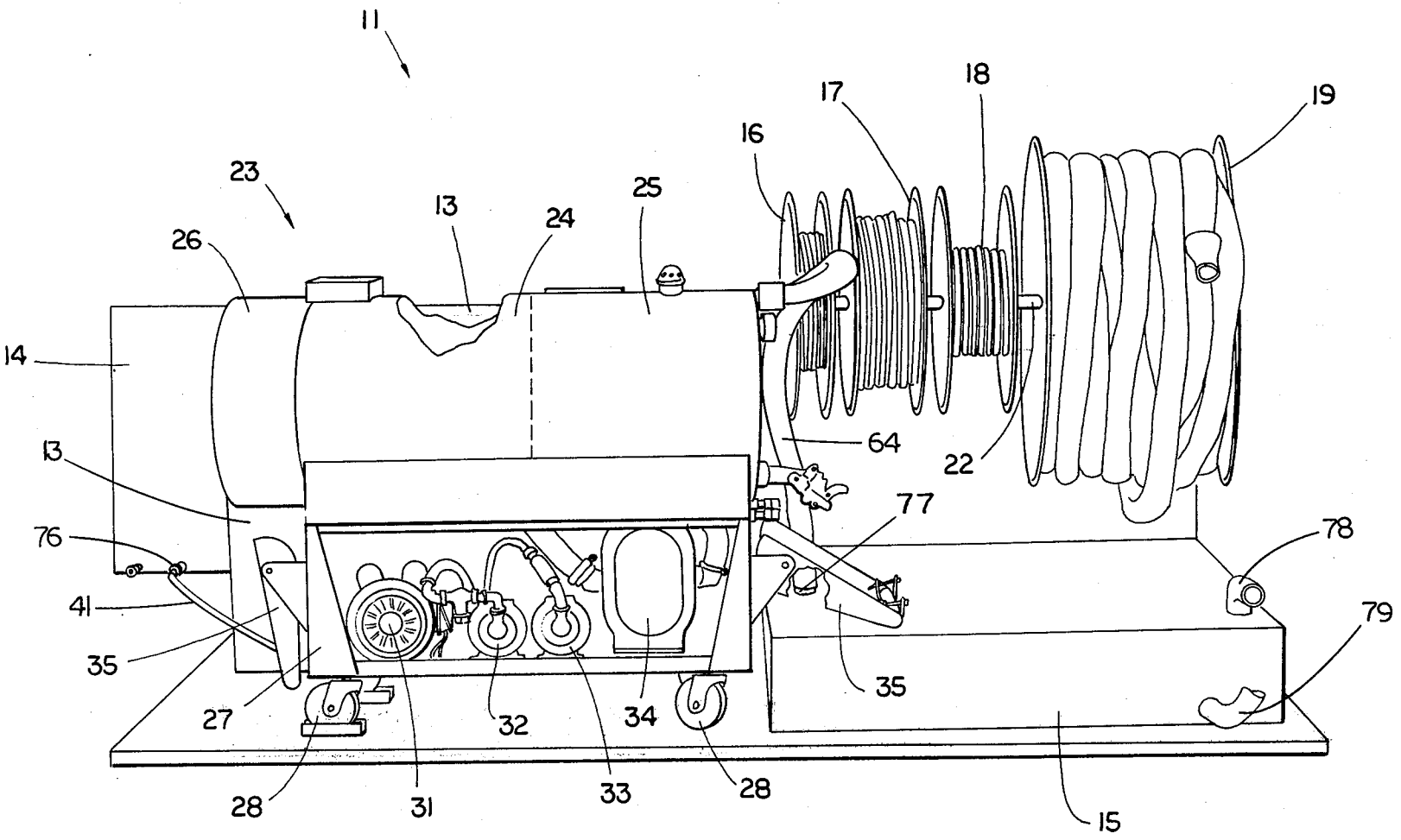
FIG. 2 is a perspective view of the mobile cleaning unit in FIG. 1 removed from the van.
Figure 3:
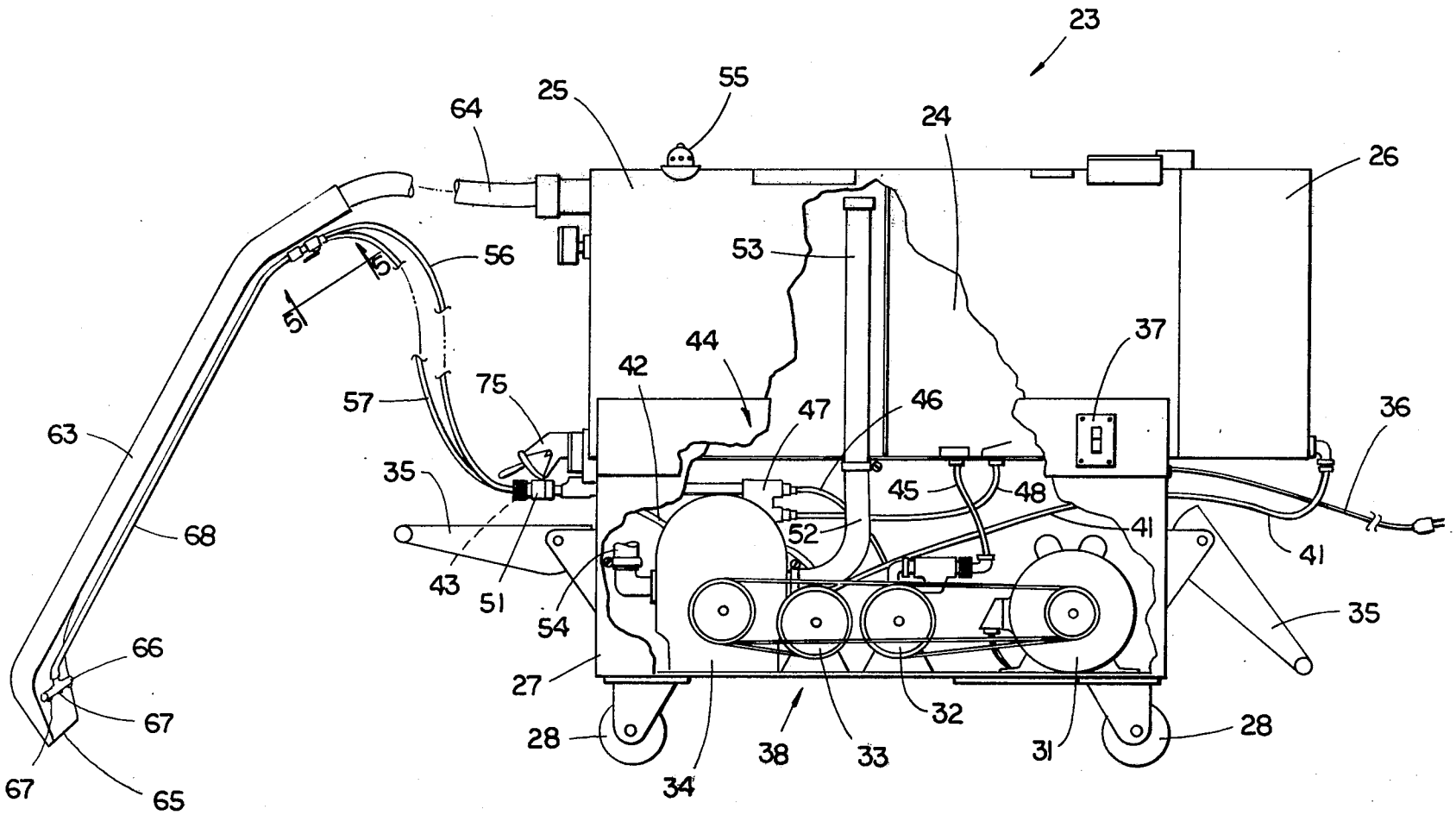
FIG. 3 is a reversed and enlarged side view of the portable cleaning unit in FIGS. 1 and 2 with a portion broken away to reveal the internal structure of the unit.
Figure 4:
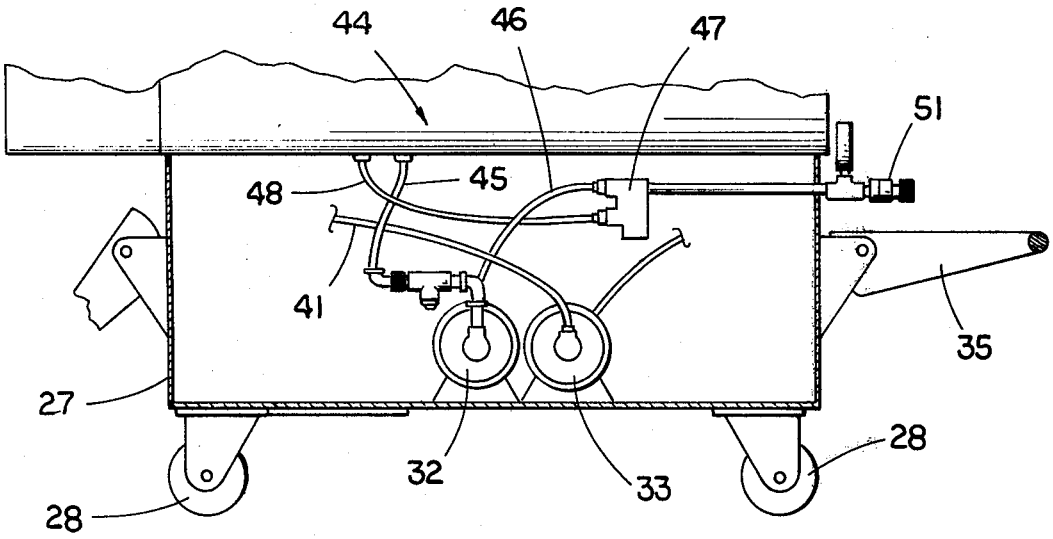
FIG. 4 is an enlarged partial view of the mobile unit in FIGS. 1 and 2 revealing the preferred hook-up of the alkaline and acid solution pumps.

Referring now to FIGS. 2 through 4, the mobile cleaning unit 11 includes an alkaline solution truck tank 13, an acid solution truck tank 14, a vacuum tank 15 and several reels 16 through 19 which are suspended on a rod 22 and contain various lengths and types of hoses required to perform "on location" carpet cleaning. Although various sizes of tanks may be used, in the preferred embodiment, acid tank 14 holds about 20 gallons of solution and alkaline and vacuum tanks 13 and 15 hold about 135 gallons each.

A portable carpet-cleaning unit 23 is also part of mobile unit 11 and is removable from van 10 to allow the cleaning of carpets in locations unreachable by the mobile truck unit, such as in large homes or office buildings. Portable unit 23 includes about a 20 gallon portable alkaline solution tank 24, a similarly sized vacuum tank 25 and about a 5 gallon acid solution tank 26, all mounted on a frame 27 which is supported by four wheel assemblies 28. Within the frame 27 is also located an electric motor 31, an alkaline solution pump 32, an acid solution pump 33 and a positive displacement vacuum pump 34, all of which combine to perform the carpet-cleaning operation of the preferred embodiment.

Various types and material compositions for the several tanks, hoses and pumps described above may be used equally well with the present invention and the same are clearly within its scope and application. However it is desirable to use materials not subject to attack by the acid solutions employed in the present invention. For that reason, the preferred mobile unit 11 and portable unit 23 use stainless steel tanks and an acid pump and hosing designed to resist attack by acid solutions.

To operate the portable cleaning unit 23 of the preferred embodiment, the first step is to mix the alkaline and acid solutions and fill tanks 24 and 26, respectively. In this regard, many alkaline and acid compounds are known to the art which will work in the present cleaning method and apparatus.

As to available alkaline cleaners and builders frequently used in carpet-cleaning operations, the list includes: sodium hydroxide; sodium silicate; sodium carbonate; sodium bicarbonate; sodium sesquicarbonate; sodium phosphate; sodium tripolyphosphate; tetrasodium pyrophosphate; sodium polyphosphate; borates and potassium and ammonium salts of the above.

As to possible acids suitable for use in the present invention, the three main groups, of course, include organic acids, inorganic acids and acid salts. Of the organic acids, some include: citric acid, fumaric acid, gluconic acid, succinic acid, glycolic acid; acetic acid; propionic acid; oxalic acid; and tartaric acid. Of the inorganic acids, some include: hydrofluoric acid; hydrofluosilicic acid; fluoboric acid; hydrochloric; sulfamic acid; polyphosphoric acid; and boric acid. Of the acid salts, some include: sodium bifluoride; ammonimum bifluroide; sodium bisulfate; sodium bisulfite; monosodium phosphate; and acid salts of the previously listed acids.

The alkaline and acid solution concentrations required for use in the present invention can vary substantially, although generally remaining in the very dilute ranges. Specifically, the alkaline solution can range in concentration from about 1% by weight at a minimum to about 50% by weight at a maximum, depending, of course, upon the specific alkaline compound used. The major factors in determining the proper range for the alkaline cleaning solution is that too high an alkaline concentration will result in a browning, burning or tinging of the carpet fiber whereas too low a concentration will not effectively clean the carpet of built-up dirt. The acid solution, on the other hand, requires only a very dilute acid concentration being at most about 1% to about 2% by weight, the major concern being that too high a concentration will leave a residue on the carpet fiber after cleaning. Various amounts and types of buffers and surfactants, corrosion inhibitors, deodorizers and antifoaming agents may also be added to either the alkaline or acid solutions to protect the equipment and also enhance the cleaning operation.

It has been found through experimentation that better cleaning action is obtained if the alkaline solution is heated to at least between about 40° C. and about 60° C. when it is blown into a carpet. Since the solution can be either premixed or mixed on location with the preferred embodiment, it is possible to get such a heated solution by mixing the concentrate with ordinary hot tap water. It would also be possible to combine a heating element with the preferred or other embodiments in order to maintain a desired solution temperature and the same would clearly be within the contemplation and scope of the present invention.

With the solutions mixed in tanks 24 and 26 and with portable unit 23 having been moved into position by means of wheel assemblies 28 and handles 35, the cleaning operation is now ready to begin. Electrical cord 36 is first connected to a standard 110 volt, 15 amp. circuit, being sure the unit is well grounded. Electric motor 31 is turned on by means of switch 37 and the pulley arrangement 38, as shown in FIG. 3, causes the motor to drive both solution pumps 32 and 33, as well as vacuum pump 34.

Acid solution pump 33 has an inlet line 41 connected to portable acid solution tank 26 and an outlet line 42 which carries the acid solution from pump 26 to a fitting 43 on the outside of portable cleaning unit 23.

Alkaline solution pump 32, on the other hand, is connected to portable alkaline solution tank 24 by means of a recirculating system 44 which includes an inlet line 45, outlet line 46 and a pressure regulator connection 47 and bypass line 48, as shown in FIG. 4. During normal operation, the pump 32 pumps the alkaline solution through outlet line 46 and fitting 51. When the pressure built up at connection 47 reaches a present limit, however, as when the alkaline solution is not being used, connection 47 allows the solution to flow back through bypass line 48 into tank 24 thereby recirculating the solution and not allowing the alkaline compound to settle or precipitate out of solution.

Although various pump pressures may be used with the present invention, in the preferred embodiment, alkaline solution pump 32 may be adjusted to blow the alkaline solution into a carpet at a pressure of between about 80 pounds per square inch (hereinafter referred to as psi) and about 120 psi. In this regard, it has been found through experimentation that alkaline pressures below about 80 psi often soak the carpet fiber to an undersirable degree whereas pressures above about 120 psi tend to blow the solution too far down into the carpet often soaking the carpet bed and mat. These alkaline pressures differ substatially from the preferred acid solution pump pressure of between about 40 psi and about 70 psi, the major difference being that the fine spray of acid solution is blown lightly over the surface of the carpet in the preferred embodiment instead of directly into the carpet as with the alkaline solution thereby eliminating any soaking problem. However, as with the alkaline solution pressure, the acid solution pressure can vary greatly, depending upon the concentration used, the particular spray nozzle dimensions and the specific method and technique of application employed, such variations being clearly within the contemplation of the present invention and the scope of the accompanying claims.

The positive displacement vacuum pump 34 of the preferred embodiment includes a vacuum hose 52 connected to a vacuum tank standpipe 53 and creates a vacuum in portable vacuum tank 25 by drawing or sucking out the air through vacuum hose 52 and blowing it out at exhaust hose 54 and conventional muffler system (not shown). In the preferred embodiment, vacuum pump 34 draws a vacuum equivalent to about seven inches of mercury in tank 25. This vacuum can, of course, be varied substantially and a pressure relief valve 55 connected to tank 25 can be adjusted to partially relieve the vacuum in tank 25 if it becomes too great.

Two lines or hoses 56 and 57 carry the alkaline and acid solutions, respectively, under pressure from fittings 51 and 43 to the two inlet connections 58 and 61 on a conventional two-way valve 62. This valve 62 is positioned on the underside of the applicator or head 63 which is used to apply and then pick up the alkaline and acid solutions. Head 63 of the preferred embodiment is elongated and generally tubular and is made of cast aluminum for its lightness in weight, although other materials can be readily substituted. One end of head 63 is tubular in cross section to receive vacuum return line 64 and the other end is flattened, having only a long narrow slot or opening 65 for picking up and removing the dirt and solutions from a carpet. This slot 65 is about twelve inches in length in the preferred embodiment, although various other lengths may work equally well. An adaptor 66 having three spray jets or nozzles 67 is attached to the underside of head 63 near slot 65. A line or hose 68 connects adaptor 66 to the outlet connection 71 on valve 62 so that the alkaline and acid solutions may be carried under pressure to adaptor 66 and spray jets 67 where the solution is then sprayed or blown into the carpet fiber.

Figure 5:
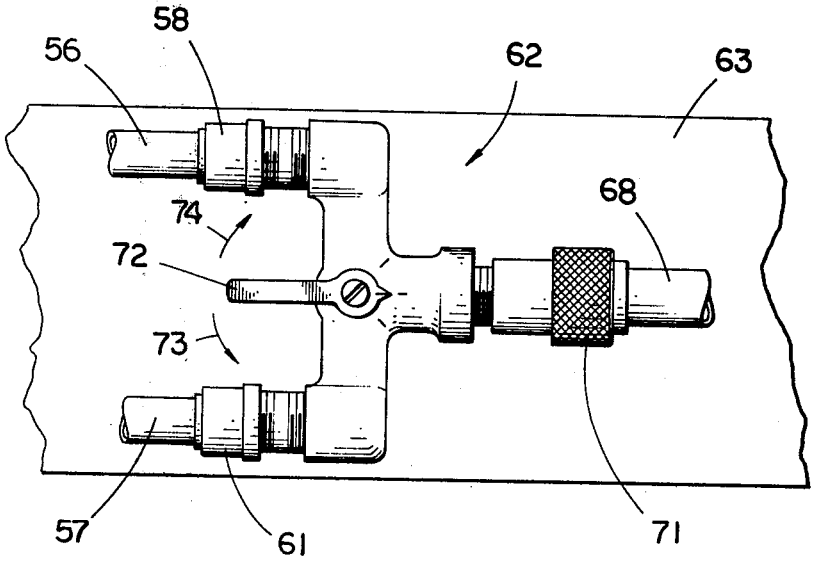
FIG. 5 is an enlarged view of the two-way valve in FIG. 3 taken along line 5—5.

Two-way valve 62, as better shown in FIG 5, has a lever 72 which is movable through three positions. When moved in the direction of arrow 73, valve 62 allows the alkaline solution to flow through lines 56 and 68 and be blown into the carpet by jets 67. When moved in the direction of arrow 74, however, valve 62 opens the acid solution line 57 to line 68 and jets 67. When positioned as shown in FIG. 5, neither solution is allowed to pass valve 62 and the entire operation is thus stopped.

In practicing the preferred method of the present invention using portable unit 23, motor 31 is first turned on with lever 72 positioned as shown in FIG. 5. The head or applicator 63 is held in position over the surface of the carpet and lever 72 is then moved in the direction of arrow 73. At this time, the dilute alkaline solution is blown under pressure into the carpet fiber. As this occurs, the head is drawn back across the blown carpet surface thereby allowing the blown solution and loosened dirt to be drawn into the narrow slot 65 and removed from the carpet by the vacuum created by pump 34. The removed solution and dirt is carried through vacuum return line 64 into vacuum tank 25 and stored until it can be later discarded through drain valve 75. This cleaning action is continued until a given surface area of the carpet has been washed at least once, the exact duration of such washing being dependent upon many factors including the solution concentration, type and color of carpet and the specific technique used by the serviceman.

At this time, the normal prior art cleaning operation is completed and the carpet is clean except for the high alkaline residue left on the carpet by the alkaline cleaning solution. As previously discussed, this alkaline residue is very detrimental because it attracts dirt and thereby increases and accelerates the rate of resoiling for the carpet fiber.

The preferred method of the present invention, however, does not stop after this washing operation. Instead, lever 72 is now moved in the direction of arrow 74 and the washed carpet is now rinsed with a light spray of dilute acid solution thereby neutralizing the alkaline residue and substantially retarding the rate of resoiling for the carpet. As before, the acid solution is blown through spray jets 67 under pressure into the carpet fiber and is immediately removed from the carpet through slot 65 by means of the vacuum created in tank 25.

With the carpet now washed and the remaining alkaline residue neutralized, the preferred cleaning operation and method of the present invention is completed. The carpet fiber is resistant to resoiling with a pH reading of between about 7 and 8 and the portable unit 23 can be returned to its position in mobile unit 11, as shown in FIGS. 1 and 2.

If the carpet to be cleaned is located in a home, office or other location such that mobile cleaning unit 11 and the hoses on reels 16 through 19 can be used without removing portable unit 23, the cleaning operation is substantially similar to that described above. In contrast, however, solution pumps 32 and 33 and vacuum pump 34 are connected to trunk tanks 13, 14 and 15, respectively, instead of portable tanks 24, 26 and 25. This is accomplished by connecting inlet line 41 of acid pump 33 to connector 76 on tank 14, as shown in FIG. 2, and then connecting inlet line 45 and bypass line 48 to appropriate connectors (not shown) near the bottom of trunk tank 13. In addition, line 64 is connected between portable tank 25 and a connector 77 located on the upper surface of vacuum tank 15 in order to create a vacuum in tank 15 and thereby draw the removed dirt and blown solutions through a head and return line (not shown) connected to tank 15 at adaptor 78. The waste solution can be later drained from tank 15 through a second drain line 79.

Another advantage of the present invention is that the waste solution poses no environmental problems because the removed acid solution substantially neutralizes any remaining alkalinity in the waste solution and thus allows it to be disposed of in any conventional manner.

EXAMPLE

One example of the preferred method of the present invention using portable cleaning unit 23 of the preferred embodiment, as above described, is as follows: First, about a 0.6% by weight acid solution was prepared in tank 26 by mixing 120 milliliters (about 4 ounces) of hydroflousilicic acid with 19 liters (about 5 gallons) of water containing a small amount of a lubricating surfactant. Second, a heated alkalinic solution at about 1.25% by weight and registering a pH of 12 was prepared in tank 24 by mixing 850 milliliters (about 29 ounces) of trisodium phosphate with 76 liters (about 20 gallons) of hot water, at a temperature of 45° C., containing small amounts of both a deodorizing and an antifoaming agent. Next, having moved the unit 23 to the carpet location and having activated motor 31, a fine spray of the alkaline solution was blown under a pressure of 120 psi into the carpet and the loosened dirt and blown solution was removed from the carpet using head 63, as previously described. A test for alkalinity of the carpet fiber after such washing revealed that the carpet fiber exhibited a pH of between 11 to 12, as did the original alkaline solution. Using the same head 63 and method of application, a light spray of the acid solution was then blown under a pressure of 80 psi into the carpet and the blown acid solution was removed from the carpet by drawing a vacuum of 7 inches of mercury over the washed and blown carpet. A second test for alkalinity of the carpet fiber after such rinsing revealed that the carpet fiber was without alkalinity, registering a pH of between 7 to 8. The carpet was thus cleaned of both dirt and any residual alkalinity which might tend to accelerate its rate of resoiling. Unit 23 was then returned to mobile unit 11 and the waste solution later dumped from tank 25 through drain valve 75.

What is claimed is:

1. A method for cleaning a carpet on location without removing the carpet to a cleaning plant comprising:
- (a) washing the carpet on location with an alkaline solution;
- (b) and neutralizing the alkaline residue left on the carpet after said washing, said neutralizing comprising:
  - (1) blowing a spray of an acid solution under pressure into the washed carpet;
  - (2) and removing the blown acid solution from the carpet after said blowing by drawing a vacuum over the washed and blown carpet.

2. The method of claim 1 wherein said blowing is with a dilute acid solution at a concentration of about at most 1% by weight.

3. The method of claim 1 wherein said washing comprises:
- (a) blowing a heated spray of the alkaline solution under pressure into the carpet;
- (b) and removing the blown alkaline solution and loosened dirt from the carpet after said blowing by drawing a vacuum over the blown carpet.

4. The method of claim 3 wherein said blowing of the acid solution is with a dilute acid solution at a concentration of about at most 1% by weight.

5. The method of claim 4 wherein said blowing of the alkaline solution is at a pressure of between about 80 psi and about 120 psi, said blowing of the acid solution being at a pressure of between about 40 psi and about 70 psi.

6. A method of retarding the rate of resoiling of a carpet after the carpet has been washed on location with an alkaline solution comprising:
- (a) contacting a washed carpet on location with an acid solution, said contacting comprising:
  - (1) blowing a spray of dilute acid solution under pressure into the washed carpet, the acid solution being at a concentration of about at most 1% by weight;
  - (2) and removing the blown acid solution from the carpet after said blowing by drawing a vacuum over the washed and blown carpet.

7. The method of claim 1 wherein said neutralizing is to a pH of between about 7 and about 8.

8. The method of claim 1 wherein said blowing is of a fine spray of acid solution lightly over the surface of the washed carpet.

* * * * *